US005415818A

United States Patent [19]

Cloutier et al.

[11] Patent Number: 5,415,818

[45] Date of Patent: May 16, 1995

[54] FLASH SPINNING PROCESS FOR FORMING STRONG DISCONTINUOUS FIBRES

[75] Inventors: Sylvie Cloutier, Kingston; Lynne M. Manuel, Seeley's Bay; Vaclav G. Zboril, Kingston, all of Canada

[73] Assignee: Du Pont Canada Inc., Mississauga, Canada

[21] Appl. No.: 143,765

[22] Filed: Nov. 1, 1993

[30] Foreign Application Priority Data

Nov. 10, 1992 [GB] United Kingdom ..... 9223563

[51] Int. Cl.[6] ..... D01D 5/11

[52] U.S. Cl. ..... 264/13; 264/140; 264/205; 264/211; 264/211.14

[58] Field of Search ..... 264/11, 12, 13, 85, 264/140, 141, 142, 143, 205, 211, 211.14

[56] References Cited

U.S. PATENT DOCUMENTS

| | | | |
|---|---|---|---|
| 3,081,519 | 1/1962 | Blades et al. | 57/248 |
| 4,054,625 | 10/1977 | Kozlowski et al. | 264/13 |
| 4,189,455 | 2/1980 | Raganato et al. | 264/12 |
| 4,352,650 | 3/1981 | Marshall | 425/174.8 E |
| 4,600,545 | 7/1986 | Galli et al. | 264/11 |
| 5,043,108 | 8/1989 | Samuels | 264/13 |
| 5,093,060 | 2/1991 | Samuels et al. | 264/143 |
| 5,279,776 | 1/1994 | Shah | 264/12 |

*Primary Examiner*—Leo B. Tentoni

[57] ABSTRACT

The process of this invention for making strong, discontinuous fibers from a polyolefin includes feeding a solution of polyolefin dissolved in an organic solvent at a pressure that is at least autogenous pressure to a spinneret. Plexifilamentary film-fibril strands are formed by flash spinning, by passing said solution through the exit of the spinneret and into a tunnel at a lower pressure and temperature than the solution, the temperature being greater than the boiling point of the organic solvent. At or subsequent to the exit from the spinneret but inside the tunnel, the strands and solvent are contacted in the tunnel with an inert fluid that has a liquid and a vapor phase, the amount of inert fluid being such that the ratio of the total volumetric flow rate of solvent vapor plus inert fluid vapor to the mass flow rate of the polymer is greater than 4.5 $m^3/kg$ in the tunnel. The temperature of the inert fluid in the tunnel is 2°–40° C. lower than the melting point of the polymer. Strong discontinuous fibers are recovered. The fibers, especially in the form of a pulp, may be used as part of thermally bonded blends with cellulose, as a filler and in the form of sheet.

18 Claims, 3 Drawing Sheets

FLASH SPINNING PROCESS FOR FORMING STRONG DISCONTINUOUS FIBRES

BACKGROUND OF THE INVENTION

The present invention relates to a process for flash spinning strong discontinuous fibers, especially strong discontinuous plexifilamentary film-fibril strands, from fibre-forming polyolefins in which a mixture of solvent and strands formed at the exit of a spinneret in a flash spinning process is subjected to a high velocity fluid. The fluid is a mixture of steam and water.

As used herein, "plexifilamentary film-fibril strands of polyolefin" means strands which are characterized as a three dimensional integral network of a multitude of thin, ribbon-like film-like elements of random length and of a thickness in the range of about 1–20 microns, with an average thickness of less than about 10 microns, generally coextensively aligned with the longitudinal axis of the strand. The film-fibril elements intermittently unite and separate at irregular intervals in various places throughout the length, width and thickness of the strand to form the three-dimensional network. Such strands are known, being described in further detail in Blades and White, U.S. Pat. No. 3,081,519 which issued Mar. 19, 1963. In addition, as used herein "discontinuous" means that the strands have a length of not more than 100 mm.

Blades and White describe a flash-spinning process for producing continuous plexifilamentary film-fibril strands from fibre-forming polymers. A solution of polymer in a liquid that is a non-solvent for the polymer at or below its normal boiling point, is extruded at a temperature above the normal boiling point of the liquid and at autogenous or higher pressure through a spinneret into a medium of lower temperature and substantially lower pressure. This flash spinning causes the liquid to vaporize and form a continuous plexifilamentary film-fibril strand. Preferred polymers include crystalline polyhydrocarbons e.g. polyethylene and polypropylene. Commercial spunbonded products have been made from polyethylene plexifilamentary film-fibril strands obtained by flash-spinning using trichlorofluoromethane as solvent, but that halocarbon has been implicated in the depletion of the earth's ozone.

It is possible to form discrete fibers by spinning a polymer of relatively low molecular weight in a conventional spinning process, which is how some commercial pulps are manufactured, but it is more difficult to produce discrete fibers from high molecular weight polymers. It is known that the spinneret and tunnel used in flash spinning a polymer solution are important with respect to properties of flash spun continuous fibers, e.g. tenacity and elongation to break. For instance, U.S. Pat. No. 4,352,650 of Marshall, which issued Oct. 5, 1982, discusses optimization of the tunnel for increasing fibre tenacity e.g. from 4.2 to 5.2 grams/denier, of flash spun continuous fibers. In general, fibre tenacity may be increased by as much as 1.3 to 1.7 times by using a tunnel at the exit to the spinneret.

Various methods are known for making discrete fibers using a secondary fluid. For example, flash-spinning a polyolefin discrete fibre from polymer dissolved in solvent containing water in quantities sufficient to form an emulsion or inverse emulsion is described by Kozlowski in U.S. Pat. No. 4,054,625, which issued Oct. 18, 1977. A process for the manufacture of discontinuous fibers is described in published PCT patent application No. WO 93/06265 of A. Shah. U.S. Pat. No. 4,600,545 of P. Galli et al discloses ejecting a solution of a polyolefin at above autogenous pressure into a zone of lower pressure and, after allowing partial expansion of the solution, contacting with a jet of a. high-speed fluid.

U.S. Pat. No. 5,043,108 of S. Samuels, which issued Aug. 27, 1991 discloses flash spinning of a mixture of organic solvent, polyethylene and a non-solvent or spin aid, especially water or an alcohol, or mixtures thereof, in which the amount of water is less than the saturation limit of water in the organic solvent. A process for the manufacture of a polyolefin pulp in which strands are formed and shredded is disclosed in U.S. Pat. No. 5,093,060 of S. Samuels and V. G. Zboril, issued Mar. 3, 1992. However, while it is possible to produce continuous filaments using a flash spinning process and to subsequently shred the continuous filaments by mechanical means to form discontinuous filaments, such mechanical shredding tends to fuse the ends of the shredded filaments, even if the shredding is carried out under water. Fused ends make it difficult or impossible to open up the resultant web of fibers, as well as reducing fibre orientation and strength. For these reasons, processes that produce discontinuous fibers without requiring use of mechanical shredding means would be preferred.

SUMMARY OF THE INVENTION

An improved flash spinning process has now been found in which discontinuous plexifilamentary film-fibril strands, especially strong oriented and discontinuous fibrils, may be formed.

Accordingly, the present invention provides a continuous process for the manufacture of strong discontinuous fibers from a polyolefin, comprising the steps of:

(a) feeding a solution of polyolefin dissolved in an organic solvent at a pressure that is at least autogenous pressure to a spinneret;

(b) flash spinning plexifilamentary film-fibril strands by passing said solution through the exit of the spinneret and into a tunnel at a lower pressure and temperature than the solution, said temperature being greater than the boiling point of the organic solvent;

(c) at or subsequent to the exit from the spinneret but inside the tunnel, contacting the strands and solvent in the tunnel with an inert fluid, said inert fluid having a liquid and a vapor phase, the amount of inert fluid being such that the ratio of the total volumetric flow rate of solvent vapor plus inert fluid vapor to the mass flow rate of the polymer is greater than 4.5 $m^3/kg$ in the tunnel, the temperature of the inert fluid in the tunnel being 2°–40° C. lower than the melting point of the polymer; and (d) recovering strong discontinuous fibers.

In a preferred embodiment of the present invention, the inert fluid is a mixture of water and steam, preferably such that the ratio of steam to water is in the range of 20:80 to 80:20 on a weight basis, especially in the range of 35:65 to 65:35.

In another embodiment, the tunnel is a venturi-shaped tunnel having a restricted diameter immediately subsequent to the exit, and the strands and solvent are contacted with the inert fluid prior to the restricted diameter of the venturi-shaped tunnel.

In a further embodiment, the volume of the inert fluid produced in the tunnel in step (c) is 100–400% of the volume of the solvent vapours in the tunnel.

BRIEF DESCRIPTION OF THE DRAWINGS

The present invention will De described with particular reference to the use of a mixture of steam and water as the inert fluid, and with reference to the embodiments shown in the drawings, in which:

FIG. 1 shows a portion of apparatus used in a flash spinning process, generally indicated by 1. Apparatus 1 has a feed section 2, a spinneret 3 having spinneret exit 4 and a venturi-shaped tunnel 5. Feed section 2 feeds polymer solution from a source (not shown) to spinneret 3. Feed section 2 is shown as being tapered immediately adjacent to spinneret 3. Spinneret 3 is located between feed section 2 and venturi-shaped tunnel 5, and has a orifice therethrough (not shown) that terminates in spinneret exit 4.

Figure 1:
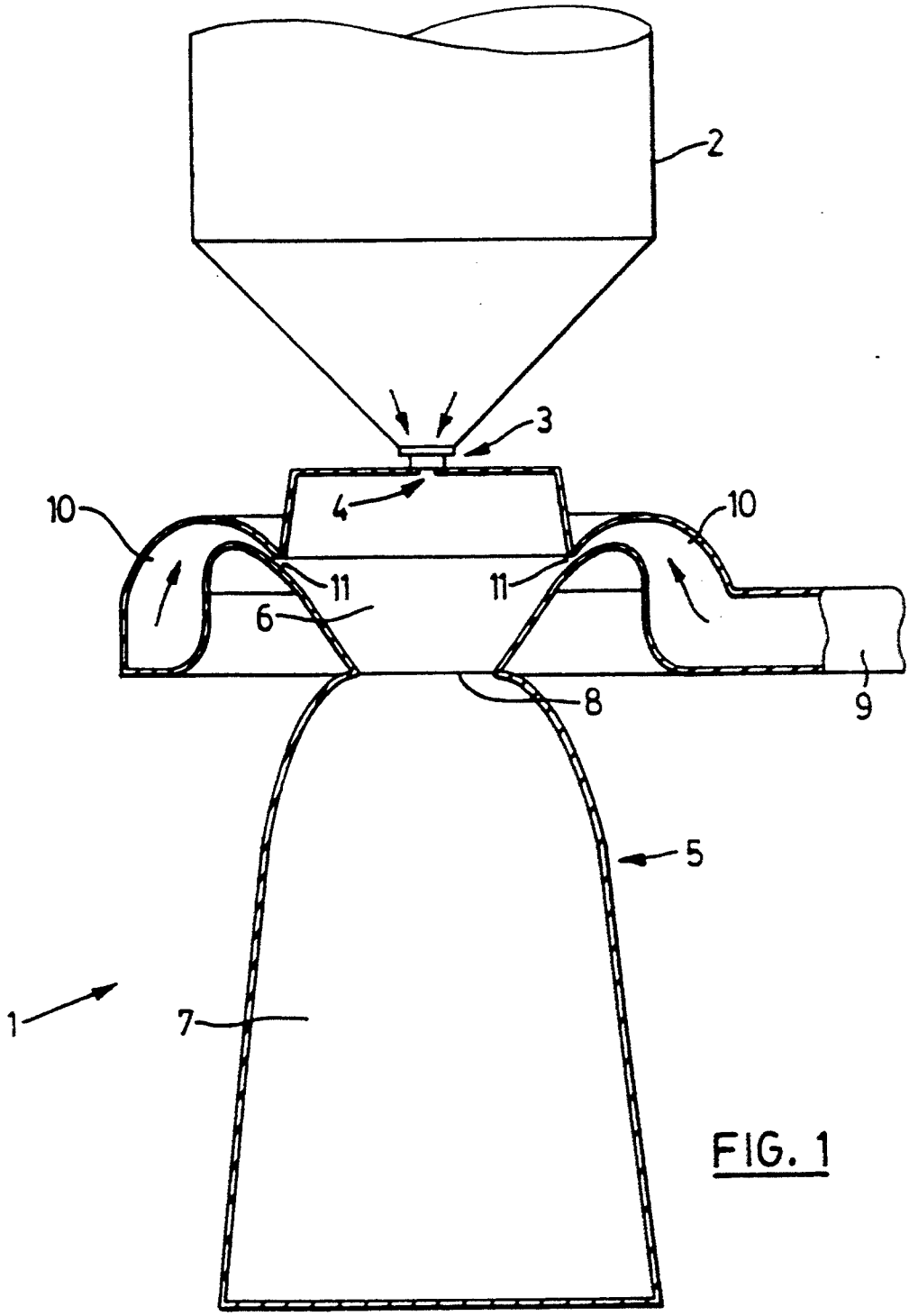
FIG. 1 is a schematic representation of an orifice and tunnel of a flash spinning process, in which a venturi-shaped tunnel is used.

Venturi-shaped tunnel 5 has upper chamber 6 and lower chamber 7 that are separated by venturi restriction 8. Lower chamber 7 is an expanded chamber, compared with venturi restriction 8, being of increasing diameter as it extends away from venturi restriction 8. Upper chamber 6 has a diameter substantially greater than the orifice of the spinneret, especially at least four times and preferably 6–15 times greater than the orifice of the spinneret. Upper chamber 6 tapers in its lower portion towards venturi restriction 8. It is important that the tapering of upper chamber 6 be smooth, to reduce likelihood that fibers passing from the orifice and through venturi restriction 8 will become entangled or restrained. Venturi restriction 8 has a diameter that is not more than 90% of that of the maximum diameter of upper chamber 6, especially not more than 55% of that maximum diameter. Upper chamber 6 and lower chamber 7 are relatively short in length, being typically about 5–20 mm.

Fluid pipe 9 conveys the inert fluid to upper chamber 6, through inlet feed section 10 and feed orifice 11. Feed orifice 11 is shown as being located in upper chamber 6; feed orifice 11 is preferably an annular orifice and, in any event, should provide uniformity of flow of inert fluid in upper chamber 6. The angle at which the inert fluid passing from feed orifice 11 impinges on the fibers and solution passing from spinneret 3 is less than 90° and preferably in the range of 20° to 60°.

Figure 2:
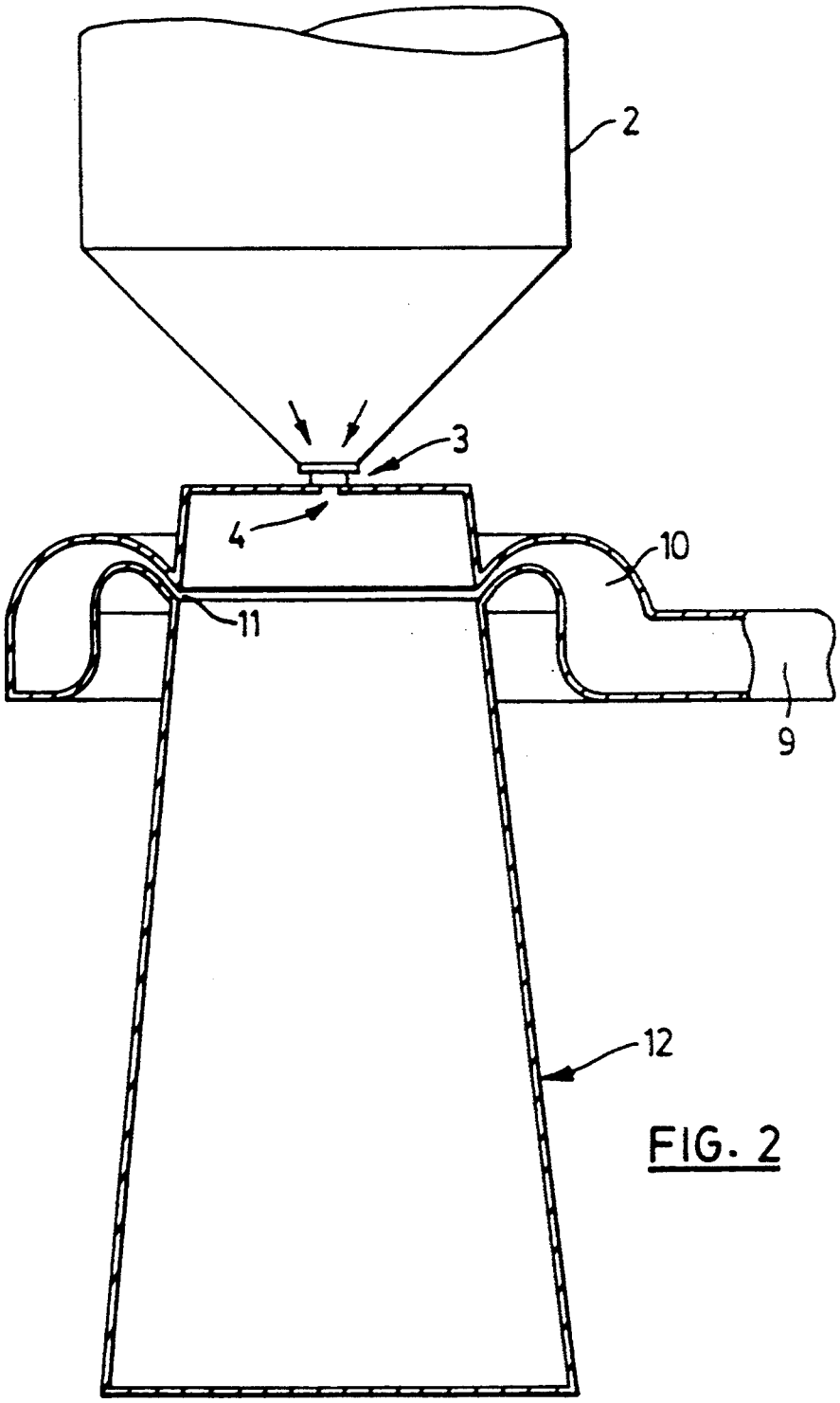
FIG. 2 is a schematic representation of an orifice and tunnel of a flash spinning process, in which a cone-shaped tunnel is used.

FIG. 2 shows an apparatus used in flash spinning that differs from that of FIG. 1 in the shape and design of the tunnel. The apparatus has a feed section 2, a spinneret 3 having spinneret exit 4 and a tunnel 12. Feed section 2 feeds polymer solution from a source (not shown) to spinneret 3, and is shown as being tapered immediately adjacent to spinneret 3. Spinneret 3 is located between feed section 2 and tunnel 12.

Tunnel 12 has only one chamber that is cone-shaped and tapers outwardly as the distance from spinneret 3 increases. The taper is smooth and continuous, and in the embodiment illustrated is at an angle of about 5°; however, the angle may be 0°–30° and preferably 0°–10°. Fluid pipe 9 conveys the inert fluid to tunnel 12, through inlet feed section 10 and feed orifice 11. Feed orifice 11 is shown as being an annular orifice located in the upper section of tunnel 12.

Figure 3:
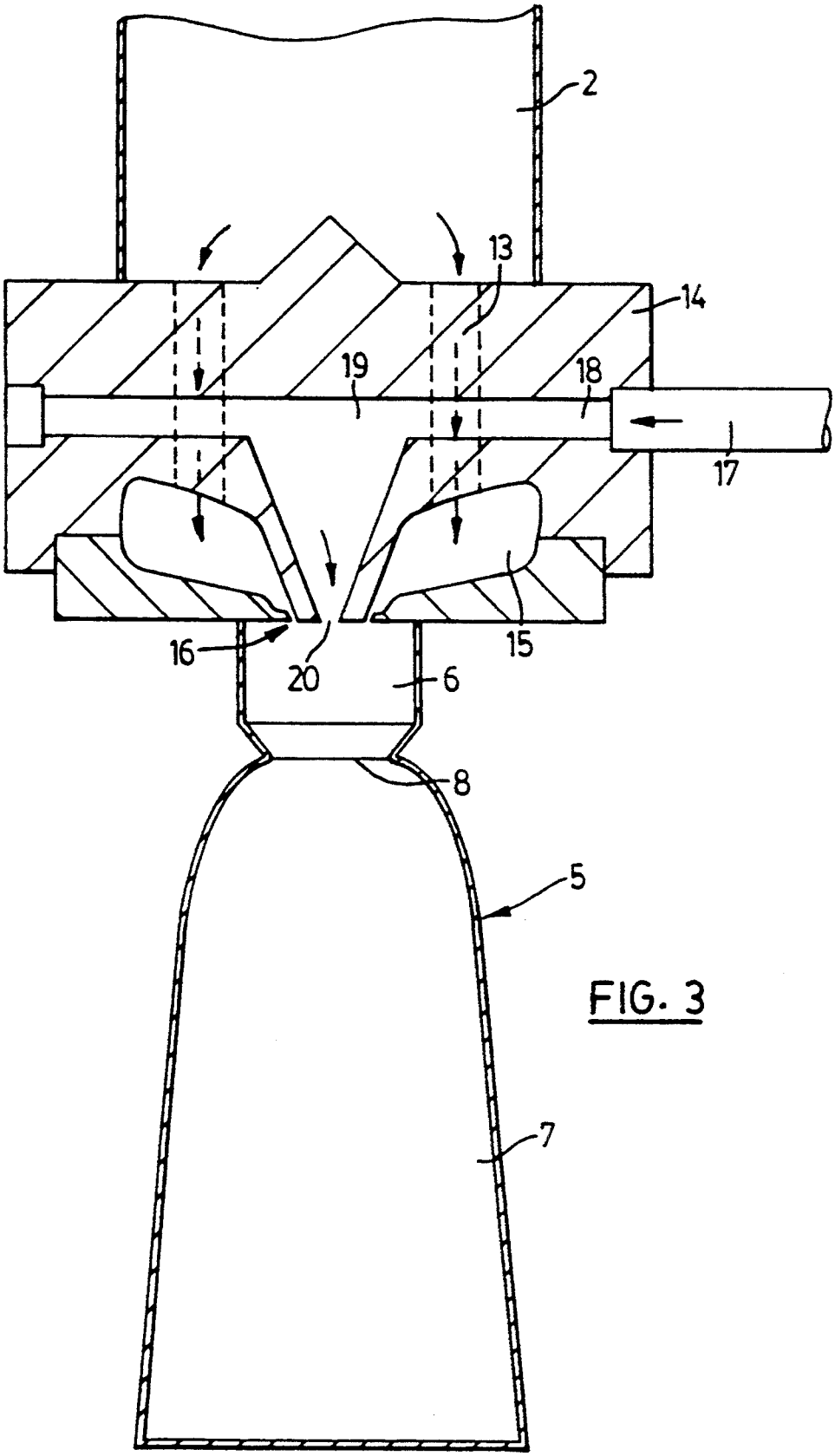
FIG. 3 is a schematic representation of a variation of the embodiment of FIG. 1.

FIG. 3 shows another embodiment of the apparatus having a venturi-shaped tunnel 5 with upper chamber 6, lower chamber 7 and venturi restriction 8. Feed section 2 is connected to polymer channel 13 passing through spinneret block 14 into spinneret chamber 15 that connects to spinneret exit 16. Fluid pipe 17 connects to fluid channel 18 in spinneret block 14. Fluid channel 18 in turn connects to fluid chamber 19 which exits at fluid exit 20. Spinneret exit 16 is axially located, and is in the form of an annular array of holes or an annular gap around fluid exit 20.

In operation, polyolefin is dissolved in an organic solvent. The polyolefin may be in the form of pellets or powder, or other forms known in the art, having been previously polymerized from monomers. Alternatively, the polyolefin is already dissolved in an organic solvent e.g. it is a solution of polymer in organic solvent from a process for the polymerization of monomers.

The polyolefin may be a high molecular weight homopolymer of ethylene or copolymer of ethylene and at least one $C_4$–$C_{10}$ hydrocarbon alpha-olefin e.g. butene-1, hexene-1 and/or octene-1. The polyolefin may also be a homopolymer of propylene or copolymer of propylene with a minor amount of ethylene. A wide variety of such polymers, including by type of monomer(s) used, molecular weight, molecular weight distribution and other properties are commercially available. In preferred embodiments in which the polyolefin is a homopolymer of ethylene or copolymer of ethylene and at least one $C_4$–$C_{10}$ hydrocarbon alpha-olefin, the density is in the range of 0.930 to 0.965 g/cm$^3$ especially in the range of 0.940 to 0.960 g/cm$^3$. The melt index of the polyolefin is preferably less than 15 dg/min i.e. in the range of from so-called "no-flow" e.g. less than about 0.01 dg/min, to 15 dg/min, especially in the range of 0.50 to 7.0 dg/min; melt index is measured by the method of ASTM D-1238 (condition E).

A variety of organic solvents may be used in the process, examples of which include pentane, hexane, cyclohexane, heptane, octane, methyl cyclohexane and hydrogenated naphtha, and related hydrocarbon solvents, and mixtures of solvents. Mixtures of solvents and minor amounts of non-solvents i.e. mixtures of solvents and spin-aids, may also be used e.g. mixtures of cyclohexane and water. The use of mixtures of solvents and non-solvents is disclosed in the aforementioned U.S. Pat. No. 5,043,108.

The polyolefin may contain additives e.g. antioxidants, ultra violet Stabilizers, wetting agents, surfactants and other additives known for use in polyolefins, provided that the additives are capable of passing through the orifice used in the process and not otherwise adversely affecting the process.

The solution of polyolefin in organic solvent is at an elevated temperature and pressure, the solution being at a pressure that is at least the autogenous pressure and at a temperature sufficient to maintain the polyolefin in solution. In preferred embodiments, the solution also contains a non-solvent e.g. water, as a spinning aid, as described in the aforementioned patent of Samuels. The spinning aid may contain wetting agents, surfactants or the like. The temperature and pressure used, and the composition of the solution especially the percent of polymer in the solution, affect the properties of the film-fibril strands obtained on spinning and consequently the fibrous material subsequently formed in the process. For instance, the temperature, pressure and solution composition may be selected so that highly oriented fibers are obtained, such fibers being preferred.

The solution is fed through feed section 2 to spinneret exit 4 or 16, to form plexifilamentary film-fibril strands. These strands are formed as the polymer solution passes from spinneret exit 4 or 16. A mixture of steam and water is passed from feed orifice 11 or fluid exit 20 and contacts the solution passing from spinneret exit 4 or 16, substantially simultaneously with the passage of the solution from the spinneret exit. While a mixture of steam and water passes from feed orifice 11 and fluid exit 20, the fluid in fluid pipe 9 would normally be water. The process is operated under conditions such that a mixture of water and steam is formed on passage of such water from feed orifice 11 and fluid exit 20. The temperature and pressure of the mixture of steam and water are selected so as to produce the required ratio of steam to water in the tunnel.

In a preferred embodiment, the ratio of steam to water is in the range of 20:80 to 80:20 on a weight basis, especially in the range of 35:65 to 65:35. The temperature of the inert fluid is 2°–40° C. lower than the melting point of the polymer. In a further embodiment, the volume of the inert fluid produced in the venturi-shaped tunnel in step (c) is 100–400% of the volume of the solvent in the polymer solution in the venturi-shaped tunnel.

The process is preferably operated under conditions that produce oriented, strong fibers. In preferred embodiments, the fibers have a handsheet zero-span strength, as defined hereinafter, of at least 3 kg/15 mm, and especially at least 6 kg/15 mm.

It is to be understood that the surfaces of pipes, vessels and the like used in the process of the invention should be free of snag points or other obstructions that might prevent or retard the passage of the film-fibrils or fibrous material.

The fibre obtained is in the form of plexifilamentary film-fibrils in a discontinuous form; the fibers may be referred to as spin-shattered fibers. For example, the average length of the fibre is preferably in the range of 1–100 mm and especially in the range of 1–20 mm. The properties e.g. length, of the fibre depend on a number of process variables, for instance the geometry of the tunnel that is used and especially the shape of the tunnel and the point of addition of the inert fluid, ratio of inert fluid to the polymer solution, polymer concentration, the properties of the polymer per se especially the melt index of the polymer, and temperature and pressure. The diameter of the fibre is preferably less than 30 microns. The fibers have "free" ends in contrast to the fused ends that tend to result from mechanical cutting of polyethylene fibers, especially at commercial rates. This freeness of the fibers contributes to improved processing of the fibers, which usually includes a step of opening up of the fibers or separating of fibre bundles into individual fibers. Examples of preferred plexifilamentary film-fibrils are described and claimed in the copending patent application Ser. No. 08/142,098 having a filing date of Oct. 25, 1993.

The fibre may be converted to a polyethylene pulp, which has a variety of uses. For instance, the pulp may be used as part of blends with cellulose for use in e.g. diapers, disposable wipes, feminine hygiene products and incontinence products, as a filler e.g. in polymers, cement and the like, thixotropic agent in paints and as synthetic paper. In some end-uses, fibers especially longer fibers with lengths in the range of about 2–20 mm, may be used, without refining, to produce sheet structures using either wet-lay or dry-lay sheet forming technologies.

Pulp may be obtained by feeding the fibers to a refining process that reduces the length of the fibers to less than 2 mm and with an average length of about 0.80–1.20 mm as well as opening up the fibre structure. The fibers are fed to the refiner in the form of a slurry e.g. about 2% by weight, with polyvinyl alcohol added as surfactant; other surfactants may be used in combination with or instead of polyvinyl alcohol. The fibers must be of a length of not more than about 10 mm, preferably with an average length of about 6 mm or less, in order to produce an acceptable slurry. The refining process may be carried out in a pulp and paper-type refiner.

The process of the present invention produces short fibers, in comparison to the fibers produced in the aforementioned Blades and White and Samuels processes. In addition, an increase in fibre strength has been obtained. It is believed that the use of the two-phase fluid in the tunnel is important in the production of the improved fibre properties.

TEST METHODS

In the examples, the following test methods were used:

Handsheet zero span is a measurement of fibre strength, and is obtained using the procedures of TAPPI T205 om and Pulmac Troubleshooter, and the method suggested by the manufacturer thereof. Handsheets with a basis weight of 60 g/m$^2$ are made in a handsheet mould, by forming a slurry of fibers in water and then depositing the fibers on a screen using vacuum. Zero span is the force required to break a strip measuring 2.54 cm ×10 cm, using a jaw width of 15 mm and a jaw separation of 0 mm. The results are expressed in kg/15 mm; and Linear Shrinkage is measured by immersion of fibre bundles in ethylene glycol at 155° C. for 5 seconds, and is expressed as the ratio of the initial length to the shrunken length. Linear shrinkage is an indication of the orientation imparted to the fibers during the spinning process.

The present invention is illustrated by the following examples.

EXAMPLES

Example I

Fibrous material was manufactured using semi-works scale apparatus equipped with a spinneret and die as shown in FIG. 1, 2 or 3. The solution of polymer fed to the spinneret was a solution of ethylene/butene-1 copolymer dissolved in cyclohexane and containing 7% (w/w) of water as a spin aid. Water was introduced at high temperature and pressure into the zone immediately adjacent the spinneret so that a mixture of steam and water contacted the fibers exiting from the spinneret.

In the spinning vessel, the product was in the form of a slurry of fibers in water at a 0.5% consistency (w/w). The fibre slurry was conveyed, using a water-driven venturi, through a large smooth pipe to a vessel where live steam was injected to boil off residual traces of cyclohexane. The slurry, free of solvent, was further conveyed, using a water-driven venturi, through a large smooth pipe to a belt filter press where water was removed. The product was collected in the form of a loose cake with an approximately 50% solids content.

Further details of the polymer used and the conditions in the flash spinning process are given in Table I.

TABLE I

| Run No. | 1 | 2 | 3 | 4 | 5 | 6 |
|---|---|---|---|---|---|---|
| Tunnel type | s | v | v | s | v | v |
| POLYMER PROPERTIES: | | | | | | |
| Melt Index (dg/min) | 0.36 | 0.39 | 0.33 | 0.29 | 0.33 | 0.31 |
| Density (g/cm$^3$) | 0.941 | 0.945 | 0.942 | 0.945 | 0.942 | 0.946 |
| SPINNING CONDITIONS: | | | | | | |
| Solution Temperature (°C.) | 260 | 239 | 232 | 234 | 232 | 249 |
| Let-down Chamber Pressure (kPa) | 6550 | 7095 | 6310 | 5350 | 6310 | 5275 |
| Solution flow, (kg/hr) | 220 | 266 | 315 | 197 | 232 | 295 |
| Polymer in Solution (%) | 14.9 | 15.6 | 14.9 | 15.3 | 15.0 | 14.9 |
| SPIN SHATTERING CONDITIONS: | | | | | | |
| Water flow rate (kg/hr) | 0 | 210 | 210 | 275 | 210 | 288 |
| Water temperature (°C.) | — | 299 | 298 | 300 | 300 | 264 |
| Water Pressure (kPa) | — | 9070 | 13730 | 11790 | 9460 | 8930 |
| Water flashing to steam (%)* | — | 42 | 42 | 42 | 42 | 32 |
| Water to polymer ratio (kg/kg) | — | 5.1 | 4.5 | 9.2 | 6.0 | 6.5 |
| FIBRE PROPERTIES: | | | | | | |
| Linear shrinkage | 9.6 | 11.5 | 10.5 | 11.5 | 10.3 | 11.3 |
| Handsheet zero span (kg/15 mm) | 4.2 | 7.0 | 8.1 | 6.9 | 6.9 | 6.0 |
| Fibre lengths (mm) | cont. | 18–38 | 18–25 | 18–38 | 6–25 | 38–50 |

Note:
Tunnel type "v" = venturi shaped (as in FIG. 1)
Tunnel type "s" = straight (as in FIG. 2)
Solution flow = polymer plus solvent
*assumes that pressure in tunnel is 104 kPa and temperature is 100° C.
cont. = continuous fibre i.e. not spin shattered fibre In Runs 1–6, polymers of medium density viz. 0.941–0.946 g/cm$^3$ and with a low melt index viz. 0.29–0.39 dg/min, were spun into fibers using different conditions and spinneret and tunnel arrangements. Run 1 is a comparative run.

Run 1 shows the results obtained when a mixture of steam and water was not fed to the tunnel; the spinneret and straight tunnel arrangement were as shown in FIG. 2. Other spinning conditions were similar to other runs in Table I. In this run, the fibre obtained was continuous. Linear shrinkage and handsheet zero span, both of which measure fibre strength and orientation, were lower than in Run 4, which also used the arrangement of FIG. 2.

Runs 2 and 3 show the results obtained with the spinneret and tunnel arrangement of FIG. 1. A mixture of steam (42% by weight) and water was injected into the tunnel. The fibers were discontinuous, with lengths ranging from 18 to 38 mm. The handsheet zero span was also high, at 7.0–8.1 kg/15 mm. The difference in results obtained in these two runs is believed to be due to difference in the melt index of the polymers used.

The discontinuous fibers obtained in Run 4 using the straight tunnel were similar in strength and length to those of Runs 2 and 3. However, it was necessary to use a much higher ratio of water to polymer, at the same ratio of steam to water, to obtain the same properties.

The arrangement of FIG. 3, with polymer solution in the annular shaped spinneret and water injected at the centre, was used for Run 5. Results were in the range obtained in Runs 2 and 3. Fibre length was slightly shorter, with lengths between 6 and 25 mm, but a higher ratio of water to polymer (at the same ratio of steam to water) was used.

Run 6 shows the result Obtained using less steam in the tunnel. The total amount of water was the same as in the other examples, but the conditions used resulted in less water being flashed to steam. The fibre length was longer, ranging from 38–50 mm.

Example II

The procedure of Example I was repeated with polymers having a higher density than those of Example I. Further details are given in Table II.

TABLE II

| Run No. | 7 | 8 | 9 | 10 | 11 |
|---|---|---|---|---|---|
| Tunnel type | s | v | s | v | v |
| POLYMER PROPERTIES: | | | | | |
| Melt Index (dg/min) | 0.45 | 0.43 | 0.43 | 0.50 | 0.36 |
| Density (g/cm$^3$) | 0.955 | 0.958 | 0.959 | 0.956 | 0.959 |
| SPINNING CONDITIONS: | | | | | |
| Solution Temperature (°C.) | 241 | 237 | 231 | 245 | 275 |
| Let-down Chamber Pressure (kPa) | 6550 | 6340 | 6110 | 7310 | 6590 |
| Solution flow, (kg/hr) | 294 | 225 | 234 | 220 | 286 |
| Polymer in Solution (%) | 15.4 | 15.6 | 15.5 | 15.7 | 14.7 |
| SPIN SHATTERING CONDITIONS: | | | | | |
| Water flow rate (kg/hr) | 0 | 240 | 155 | 190 | 150 |
| Water temperature (°C.) | — | 302 | 297 | 300 | 240 |
| Water Pressure (kPa) | — | 10030 | 16170 | 10620 | 1930 |
| Water flashing to steam (%)* | — | 43 | 41 | 42 | 100 |
| Water to polymer ratio (kg/kg) | — | 6.9 | 4.3 | 5.4 | 3.6 |
| FIBRE PROPERTIES: | | | | | |
| Linear shrinkage | 8.9 | 10.1 | 11.7 | 11.2 | 10.0 |
| Handsheet zero span (kg/15 mm) | 5.1 | 9.0 | 7.4 | 8.8 | 8.6 |

TABLE II-continued

| Run No. | 7 | 8 | 9 | 10 | 11 |
|---|---|---|---|---|---|
| Tunnel type | s | v | s | v | v |
| Fibre lengths (mm) | cont. | 4–10 | 100–200 | 10–20 | cont. |

Note:
Tunnel type "v" = venturi shaped (as in FIG. 1)
Tunnel type "s" = straight (as in FIG. 2)
Solution flow = polymer plus solvent
*assumes that pressure in tunnel is 104 kPa and temperature is 100° C.
cont. = continuous fibre i.e. not spin shattered fibre Runs 7–11 were conducted using polymers with high density polyethylene viz. 0.955–0.959 g/cm$^2$, and a low melt index viz. 0.36–0.50 dg/min. Runs 7, 9 and 11 are comparative runs.

In Run 7, the arrangement of spinneret and tunnel as shown in FIG. 2 was used. Water and steam were not introduced into the tunnel, and thus the fibre obtained was continuous fibre. The remaining conditions were similar to those used in Run 9. Fibre strength and orientation were lower than in Run 9, which is the same trend as seen with the lower density polymers in Example I.

In Run 8, the tunnel of FIG. 1 was used, and a mixture of steam and water was introduced into the tunnel. Discontinuous fibers were obtained, with lengths generally of about 10 mm. The fibers had good strength and orientation, with a handsheet zero span of 9.0 kg/15 mm. Compared with the fibers of Runs 2 and 3 that were produced with lower density polymer, fibre strength was higher, due to the higher density polymer, and the fibre length was shorter, due to the lower melt index of the polymer.

In Run 9, the straight tunnel of FIG. 2 was used with a mixture of steam and water being introduced into the tunnel. The fibers obtained were considerably longer viz. 100–200 mm; a higher flow of water was not used to compensate for the absence of the venturi restriction in the tunnel, as had been done in Run 2. The fibers of Run 9 had lower strength than those of Run 8.

In Run 10, the tunnel and spinneret arrangement of FIG. 3 was used, with polymer being spun through annular orifices and the mixture of steam and water being injected at the centre. Other conditions were similar to those used in Run 8, and the fibers obtained had similar properties.

In Run 11, the arrangement of FIG. 1 was used, but only steam was injected (instead of a mixture of steam and water); the amount of steam was similar to that used in Run 8. The fibre obtained was strong and oriented but it was continuous fibre.

Example III

The procedure of Example I was repeated, using polymers of several different densities and melt indices, with additional attempts being made to optimize process conditions. The venturi tunnel of FIG. 1 was used in all runs.

Further details are given in Table III.

TABLE III

| Run No. | 12 | 13 | 14 | 15 |
|---|---|---|---|---|
| POLYMER PROPERTIES: | | | | |
| Melt Index (dg/min) | 1.16 | 1.90 | 7.60 | 1.90 |
| Density (g/cm$^3$) | 0.956 | 0.938 | 0.959 | 0.938 |
| SPINNING CONDITIONS: | | | | |
| Solution Temperature (°C.) | 260 | 237 | 234 | 233 |
| Let-down Chamber Pressure (kPa) | 6675 | 8550 | 8240 | 8205 |
| Solution flow, (kg/hr) | 220 | 284 | 224 | 289 |
| Polymer Solution (%) | 15.4 | 14.9 | 20.1 | 14.8 |
| SPIN SHATTERING CONDITIONS: | | | | |
| Water flow rate (kg/hr) | 265 | 250 | 268 | 0 |
| Water temperature (°C.) | 300 | 301 | 299 | — |
| Water Pressure (kPa) | 10070 | 10000 | 10510 | — |
| Water flashing to steam (%)* | 42 | 42 | 42 | — |
| HP water to PE ratio (kg/kg) | 7.8 | 6.0 | 6.0 | — |
| FIBRE PROPERTIES: | | | | |
| Linear shrinkage | 9.9 | — | — | — |
| Handsheet zero span (kg/15 mm) | 8.4 | 5.0 | 3.8 | 4.5 |
| Fibre lengths (mm) | 2–6 | 1–4 | 1–3 | 1–4 |

Note:
Solution flow = polymer plus solvent
*assumes that pressure in tunnel is 104 kPa and temperature is 100° C.
cont. = continuous fibre i.e. not spin shattered fibre The polymers used in this example were lower molecular weight polymers. In Runs 12–14, polymers of increasing melt index i.e. decreasing molecular weight, were used. Fibre strength and length decreased as the melt index increased.

Run 15 is a comparative run in which water and steam were not fed to the tunnel, but because of the relatively low molecular weight of the polymer the fibers obtained were discontinuous; the polymer was the same as that used in Run 13. In comparison, in. Runs 1 and 7 where no steam was used, the higher molecular weight polymers of those runs gave continuous fibers. The improvement obtained through the use of steam and water with lower molecular weight polymers is higher strength.

We claim:

1. A continuous process for the manufacture of strong discontinuous fibers from a polyolefin, comprising the steps of:

(a) feeding a solution of polyolefin dissolved in an organic solvent at a pressure that is at least autogenous pressure and at a temperature sufficient to maintain the polyolefin in solution, wherein the temperature is greater than the boiling point of the organic solvent to a spinneret;

(b) flash spinning plexifilamentary film-fibril strands by passing said solution through the exit of the spinneret and into a tunnel at a lower pressure and temperature than the solution, wherein the temperature of the tunnel is greater than the boiling point of the organic solvent;

(c) at or subsequent to the exit from the spinneret but inside the tunnel, contacting the strands and solvent in the tunnel with an inert fluid, said inert fluid having a liquid and a vapor phase, the amount of inert fluid being such that the ratio of the total volumetric flow rate of solvent vapor plus inert fluid vapor to the mass flow rate of the polymer is greater than 4.5 $m^3/kg$ in the tunnel, the temperature of the inert fluid in the tunnel being 2°–40° C. lower than the melting point of the polymer; and (d) recovering strong discontinuous fibers.

2. The process of claim 1 in which the solution is passed through the exit of the spinneret under conditions that produce oriented strong fibers.

3. The process of claim 1 in which the inert fluid is a mixture of water and steam.

4. The process of claim 3 in which the ratio of steam to water is in the range of 20:80 to 80:20 on a weight basis.

5. The process of claim 4 in which the ratio is in the range of 35:65 to 65:35.

6. The process of claim 3 in which the tunnel is a venturi-shaped tunnel having a restricted diameter immediately subsequent to the exit, and the strands and solvent are contacted with the inert fluid prior to the restricted diameter of the venturi-shaped tunnel.

7. The process of claim 3 in which the volume of the inert fluid produced in the tunnel in step (c) is 100–400% of the volume of the solvent vapours in the tunnel.

8. The process of claim 3 in which the strong discontinuous fibers obtained have a handsheet zero-span strength of greater than 3 kg/15 mm.

9. The process of claim 8 in which the handsheet zero-span strength is greater than 6 kg/15 mm.

10. The process of claim 3 in which the angle at which the angle of contact between the inert fluid and the strands and solvent passing from the spinneret is less than 90°.

11. The process of claim 10 in which the angle is in the range of 20°–60°.

12. The process of claim 3 in which the polyolefin is a high molecular weight homopolymer of ethylene or copolymer of ethylene and at least one $C_4$–$C_{10}$ hydrocarbon alpha-olefin.

13. The process of claim 12 in which the polyolefin is a copolymer and the alpha-olefin is selected from the group consisting of butene-1, hexene-1 and octene-1, and mixtures thereof.

14. The process of claim 12 in which the density of the polyolefin is in the range of 0.930 to 0.965 $g/cm^3$.

15. The process of claim 14 in which the melt index of the polyolefin is less than 15 dg/min.

16. The process of claim 14 in which the melt index of the polyolefin is in the range of 0.50 to 7.0 dg/min.

17. The process of claim 3 in which the solvent is cyclohexane.

18. The process of claim 17 in which the cyclohexane contains water as a spin-aid.

* * * * *